US007229343B2

(12) United States Patent
Chadda et al.

(10) Patent No.: US 7,229,343 B2
(45) Date of Patent: Jun. 12, 2007

(54) ORBITING INDEXABLE BELT POLISHING STATION FOR CHEMICAL MECHANICAL POLISHING

(75) Inventors: Saket Chadda, Phoenix, AZ (US); Timothy S. Dyer, Tempe, AZ (US); Clinton O Fruitman, Chandler, AZ (US)

(73) Assignee: SpeedFam-Ipec Corporation, Chandler, AZ (US)

( * ) Notice: Subject to any disclaimer, the term of this patent is extended or adjusted under 35 U.S.C. 154(b) by 0 days.

(21) Appl. No.: 10/711,229

(22) Filed: Sep. 2, 2004

(65) Prior Publication Data

US 2005/0009452 A1 Jan. 13, 2005

Related U.S. Application Data

(62) Division of application No. 09/705,307, filed on Nov. 3, 2000, now Pat. No. 6,793,565.

(51) Int. Cl.
*B24B 7/22* (2006.01)

(52) U.S. Cl. ..... 451/288; 451/173

(58) Field of Classification Search ..... 451/5, 451/57, 65, 288, 287, 41, 173, 168
See application file for complete search history.

(56) References Cited

U.S. PATENT DOCUMENTS 5,335,453 A 8/1994 Baldy et al.
5,403,227 A * 4/1995 Franklin et al. ..... 451/168
5,554,064 A * 9/1996 Breivogel et al. ..... 451/41
5,692,947 A 12/1997 Talieh et al.
5,722,877 A 3/1998 Meyer et al.
5,738,574 A 4/1998 Tolles et al.
5,759,918 A 6/1998 Hoshizaki et al.
5,804,507 A 9/1998 Perlov et al.
5,897,426 A 4/1999 Somekh
5,913,716 A * 6/1999 Mucci et al. ..... 451/59
6,241,585 B1 6/2001 White
6,520,833 B1 * 2/2003 Saldana et al. ..... 451/5

* cited by examiner

*Primary Examiner*—Robert A. Rose
(74) *Attorney, Agent, or Firm*—Snell & Wilmer L.L.P.

(57) ABSTRACT

An apparatus for planarizing a workpiece has a web with a face which is positioned adjacent the workpiece during planarization. At least one tension assembly is configured to maintain tension of the web. An orbiting assembly is configured to orbit the web relative to the workpiece. The apparatus for planarizing a workpiece may include first and second polishing surfaces where the first polishing surface has a substantially horizontal web with a face which is positioned adjacent the workpiece during the planarization process. The apparatus may also have a rotatable carousel and at least two workpiece carriers suspended from the carousel. Each of the carriers is configured to carry a workpiece and press the workpiece against one of the polishing surfaces while causing relative motion between the workpiece and the polishing surface. An apparatus for planarizing a workpiece which includes a plurality of polishing stations is also disclosed. At least one of the polishing stations has a web with a first face which is positioned adjacent the workpiece during planarization . The apparatus also includes an orbiting assembly configured to orbit the web relative to the workpiece.

17 Claims, 9 Drawing Sheets

ORBITING INDEXABLE BELT POLISHING STATION FOR CHEMICAL MECHANICAL POLISHING

CROSS REFERENCE TO RELATED APPLICATIONS

This is a divisional application of and claims priority to U.S. Non-Provisional application Ser. No. 09/705,307, entitled "Orbiting Indexable Belt Polishing Station for Chemical Mechanical Polishing", filed on Nov. 3, 2000, Now U.S. Pat. No. 6,793,565, which application is incorporated herein by reference.

FIELD OF INVENTION

The present invention relates generally to systems for polishing or planarizing workpieces such as semiconductor wafers. More particularly, it relates to an improved apparatus and method for planarizing a wafer using an orbiting indexable fixed-abrasive web.

BACKGROUND OF INVENTION

Many electronic and computer-related products, such as semiconductors, CD-ROMs, and computer hard disks, require highly polished surfaces in order to achieve optimum operational characteristics. For example, high-quality and extremely precise wafer surfaces are often needed during the production of semiconductor-based integrated circuits. During the fabrication process, the wafers generally undergo multiple masking, etching, and dielectric and conductor deposition processes. Because of the high-precision required in the production of these integrated circuits, an extremely flat surface is generally needed on at least one side of the semiconductor wafer to ensure proper accuracy and performance of the microelectronic structures created on the wafer surface. As the size of integrated circuits decreases and the density of microstructures on integrated circuits increases, the need for accurate and precise wafer surface polishing increases.

Chemical Mechanical Polishing ("CMP") machines have been developed to polish or planarize semiconductor wafer surfaces to the flat condition desired for integrated circuit components and the like. For examples of conventional CMP processes and machines, see U.S. Pat. No. 4,805,348, issued Feb. 21, 1989 to Arai et al; U.S. Pat. No. 4,811,522, issued Mar. 14, 1989 to Gill; U.S. Pat. No. 5,099,614, issued Mar. 31, 1992 to Arai et al; U.S. Pat. No. 5,329,732, issued Jul. 19, 1994 to Karlsrud et al; U.S. Pat. No. 5,498,196, issued Mar. 12, 1996 to Karlsrud et al;

U.S. Pat. No. 5,498,199, issued Mar. 12, 1996 to Karlsrud et al; U.S. Pat. No. 5,558,568, issued Sep. 24, 1996 to Talieh et al; and U.S. Pat. No. 5,584,751, issued Dec. 17, 1996 to Kobayashi et al.

Typically, a CMP machine includes a wafer carrier configured to hold, rotate, and transport a wafer during the process of polishing or planarizing the wafer. During a polishing operation, a pressure-applying element (e.g., a rigid plate, a bladder assembly, or the like), which may be integral to the wafer carrier, applies pressure such that the wafer engages the polishing surface with a desired amount of force. The carrier and the polishing pad are rotated, typically at different rotational velocities, to cause relative lateral motion between the polishing pad and the wafer and to promote uniform polishing.

Commercially available polishing pads may utilize various materials, as is known in the art. The hardness and density of the polishing pad depends on the material that is to be polished and the degree of precision required in the polishing process. Typically, conventional polishing pads may be formed from a blown polyurethane, such as the IC and GS series of polishing pads available from Rodel Products Corporation in Scottsdale, Ariz.

In conventional CMP apparatus, the platens use polishing pads the entire surface of which are used to planarize each wafer, with the result that the first wafer sees a totally fresh pad while the last wafer sees a pad in glazed condition. In addition, during polishing, the polishing pad wears unevenly, developing worn tracks that result in nonuniform polishing of the wafer. In order to minimize this problem, it is well known in the art to recondition the pad between each wafer, or a certain number of wafers, being processed. However, adding the pad-reconditioning step to the wafer planarization process typically slows the throughput of the apparatus. Also, while reconditioning the pad does assist in making a used pad appear more like a fresh pad, the pad nevertheless continues to deteriorate through its life introducing a variable that alters the planarization process from wafer to wafer.

Planarization of wafers using linear belts or indexable strips are known in the art. For examples of apparatus using such planarization devices, see U.S. Pat. No. 5,335,453, issued Aug. 9, 1994 to Baldy, et al., and International Application No. PCT/US98/06844, published Oct. 15, 1998. These apparatus typically include a belt which moves linearly relative to a wafer that is urged against the belt by a wafer carrier. The wafer carrier also causes rotary or oscillating movement of the wafer against the linear belt.

While prior art devices which use orbiting wafer carriers are known, such devices pose several disadvantages. The orbiting wafer carriers may generate vibrations which create noise that adversely effects endpoint detection devices, particularly acoustic endpoint detection devices. In addition, in multi-polishing station systems, the vibration generated by one wafer carrier may translate to other neighboring wafer carriers, thereby adversely affecting uniformity of the planarization performed by the neighboring wafer carriers.

A need therefore exists for an apparatus and method of planarizing wafers that enhances the planarization of the wafers. A need further exists for an apparatus and method of planarizing wafers that allows each wafer to experience similar pad conditions as all other wafers.

SUMMARY OF INVENTION

These and other aspects of the present invention will become more apparent to those skilled in the art from the following non-limiting detailed description of preferred embodiments of the invention taken with reference to the accompanying figures.

In accordance with an exemplary embodiment of the present invention, an apparatus for planarizing a workpiece includes a web with a face which is positioned adjacent the workpiece during planarization. At least one tension assembly is configured to maintain tension of the web. An orbiting assembly is configured to orbit the web relative to the workpiece.

In accordance with another exemplary embodiment of the present invention, an apparatus for planarizing a workpiece includes at least first and a second polishing surfaces wherein the first polishing surface has a substantially horizontal web with a face. The face is positioned adjacent the workpiece during the planarization process. The apparatus has a rotatable carousel and at least two workpiece carriers suspended from the carousel. The carriers are configured to carry a workpiece and press the workpiece against one of the polishing surfaces while causing relative motion between the workpiece and the polishing surface.

In accordance with yet another embodiment of the present invention, a compressible polishing pad is removably mounted to the second polishing surface.

In accordance with a further embodiment of the present invention, the apparatus has a third polishing surface having a low-compressibility polishing pad removably mounted thereto.

In accordance with yet another embodiment of the present invention, a method of planarizing a workpiece includes the steps of: loading a first workpiece on one of a plurality of workpiece carriers supported by a rotatable carousel; pressing the first workpiece against a horizontal web and causing relative motion between the first workpiece and the web so as to planarize the first workpiece; rotating the carousel to position the first workpiece adjacent a compressible polishing surface; and pressing the first workpiece against the compressible polishing surface and causing relative motion between the first workpiece and the compressible polishing surface so as to remove microscratches from the first workpiece.

In accordance with yet a further embodiment of the present invention, an apparatus for planarizing a workpiece includes a plurality of polishing stations wherein at least one of said plurality of polishing stations comprises a web with a first face which is positioned adjacent the workpiece during panarization. An orbiting assembly is configured to orbit the web relative to the workpiece.

These and other aspects of the present invention are described in the following description, claims and appended drawings.

BRIEF DESCRIPTION OF THE DRAWING FIGURES

Exemplary embodiments of the present invention will hereafter be described in conjunction with the appended drawing figures, wherein like designations denote like elements, and:

DETAILED DESCRIPTION OF THE INVENTION

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth.

Figure 1:
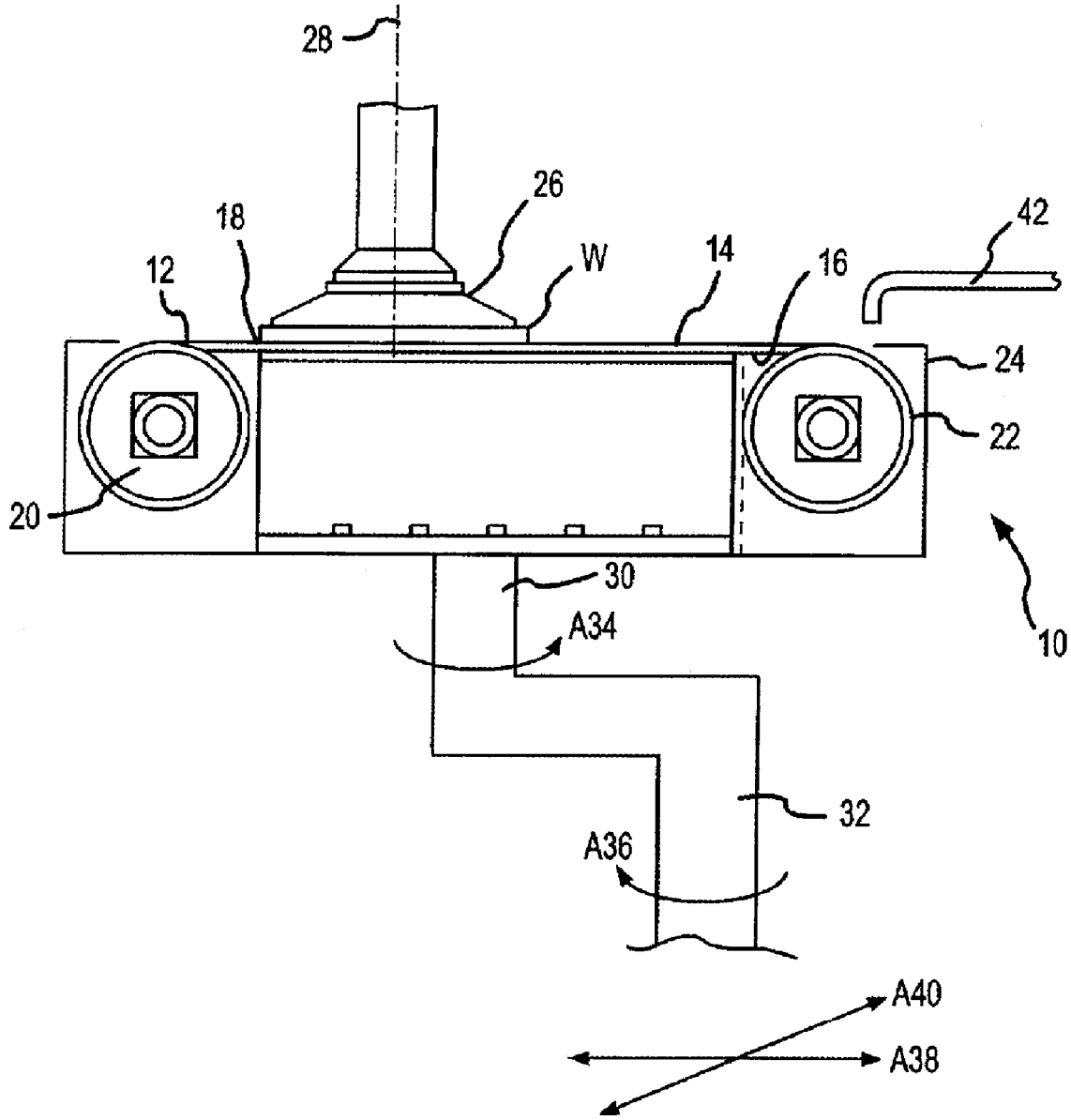
FIG. 1 is a side view illustration showing an orbiting indexable web polishing station according to an embodiment of the present invention.

A schematic representation of an exemplary embodiment of an indexable web polishing station 10 of the present invention is shown in FIG. 1. A polishing web 12 is provided with at least one side of web 12 having a fixed abrasive surface 14 (i.e., one onto which abrasives are fixedly mounted, formed or attached). One type of fixed abrasives that may be used with the present invention is discussed in detail in U.S. Pat. No. 5,958,794, issued Sep. 28, 1999 to Bruxvoort, et al., which is hereby incorporated by this reference. The web 12 preferably also has a smooth opposite surface 16 that may be laid across and supported by a supporting surface 18. The web 12 is preferably 0.25 mm thick and may have at least one side, surface 14, of the web 12 covered with microreplicated structures with fixed abrasives. The microreplicated structures may be randomly positioned on the web 12, but preferably form a pattern. The minimum width of the web 12 is dependent on the size of the wafer W to be planarized. For example, a web 12 having a width of at least 300 mm is preferred for a wafer having a 200 mm diameter. An example of a method and apparatus for planarizing wafers using a polishing web is disclosed on U.S. Ser. No. 09/519,923, assigned to Speedfam-IPEC Corporation. One or more fluids (deionized water, slurry, etc.) may be applied through conduit 42 via a fluid pump (not shown).

The abrasive characteristics of web 12 tend to deteriorate very quickly, sometimes even during the planarization of a single wafer W. However, the short life of web 12 can be overcome by constructing the web 12 in a long sheet and only exposing an amount of web 12 necessary to planarize one wafer W. Web 12 may be advanced continuously, preferably automatically, so that the wafer W is exposed to fresh web 12 during the planarization process. Alternatively, web 12 may be advanced incrementally so that the wafer W is exposed to unused segment of web 12 at given periods during the planarization process. In a further alternative embodiment, after planarization of a wafer, web 12 may be advanced, either manually or, preferably, automatically so that a subsequent wafer to be planarized is subjected to a fresh, unused segment of web 12. Web 12 may be indexed a predetermined amount, preferably between 5 mm and 300 mm, to expose fresh web 12 at indexable web polishing station 10. If web 12 is of particularly high durability, or if the process used to planarize the previous wafers is sufficiently mild, it may be possible to only index web 12 after a certain number of wafers have been planarized. The amount and timing for indexing web 12 is highly dependent on the wafer planarization process being used. Factors such as the type and quality of web 12 used, the material on the wafer being planarized, the amount of material that is being removed from the wafer and the planarization quality necessary for the wafer all affect the amount and time required for indexing web 12.

Web 12, in the form of a long sheet, may advantageously be taken from a new roll cartridge 20 with the used web 12 being fed into, and stored by, a take-up cartridge 22. The new roll cartridge 20 and take-up cartridge 22 allow a fresh web 12 to be exposed at the polishing station 10 by simply replacing the empty new roll cartridge 20 with a full new roll cartridge 20 and replacing the take-up cartridge 22, containing the old web 12, for an empty take-up cartridge 22. Alternatively, after the long sheet of web 12 has been used, the web 12 may be taken from the take-up cartridge 22 and rewound back onto the new roll cartridge 20. This would allow a fresh web 12 to be installed by simply replacing the new roll cartridge 20 containing the previously consumed web 12 with a "new" new roll cartridge 20 containing an unused web 12.

The web 12, in combination with a new roll cartridge 20 or take-up cartridge 22, should be of suitable size to be housed within a housing 24 and should not be made so large or heavy as to make loading and unloading of the new roll cartridge 20 and take-up cartridge 22 difficult. However, the longer, and thus heavier, the web 12, the fewer times the new roll cartridge 20 and take-up cartridge 22 will need to be replaced, thus increasing the CMP apparatus' uptime and availability for use. If easy replacement is desired, web 12 may be made shorter; if longer periods of time are desired between web 12 replacement, web 12 may be made longer.

Web 12 with a fixed abrasive surface 14 has been found to give good within-die planarity by removing high spots quickly on structural semiconductor wafers W. The microreplicated structures on the web 12 are designed to contact the face of wafer W at the high spots on the face of wafer W, thus concentrating the abrasive action in these areas. A further advantage is that the removal rate of material slows as the face of wafer W becomes planarized. The pressure at surface contact points are reduced as the wafer's W face becomes more planar which reduces the rate of material removal. This is due to all the high spots on the face of wafer W being removed and thus more evenly distributing the abrasive action and down-force across the entire face of wafer W.

During planarization, wafer W is held by a wafer carrier 26, which urges wafer W against web 12 with a desired amount of force. While wafer W is rotated by wafer carrier 26 about an axis 28, indexable web polishing station 10 uses orbital motion to polish wafer W. Two rotatable shafts 30 and 32 are off-set from each other by the amount of a desired orbit. The radius of the orbit is preferably less than the radius of the wafer W. Shaft 30 may rotate in the direction indicated by arrow A34 and shaft 32 may rotate at the same speed, but in the direction indicated by arrow A36. Eccentrics or cams (not shown) may be attached to shaft 32 to allow indexable web polishing station 10 to also dither (in one or more axes as indicated by arrows A38 and A40) while orbiting. An example of polishing a wafer by orbital motion is disclosed in U.S. Pat. No. 5,554,064, issued Sep. 10, 1996 to Breivogel et al., which patent is incorporated herein by reference. It is to be appreciated that a variety of other well-known means may be employed to facilitate the orbital motion of the indexable web in the present invention.

Figure 2:
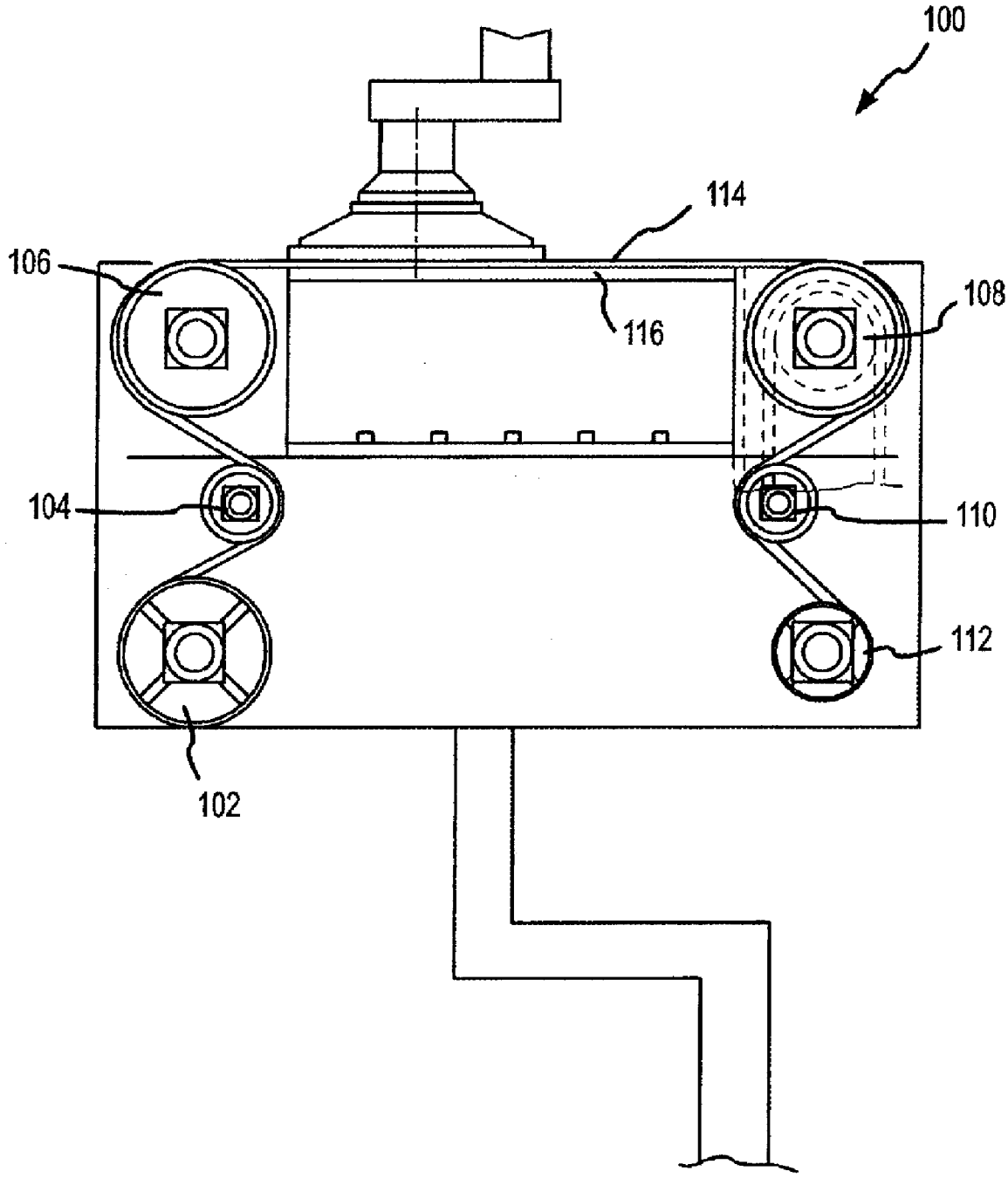
FIG. 2 is a side view illustration showing an orbiting indexable web polishing station according to another embodiment of the present invention.

In an alternative embodiment, as illustrated in FIG. 2, an indexable web station 100 may comprise a new roll cartridge 102, a first tension roller 104, a first turnbar 106, a second turnbar 108, a second tension roller 110 and a take-up cartridge 112. A web 114 may be threaded from new roll cartridge 102, passing around a side of first tension roller 104, around first turnbar 106, across supporting surface 116, around second turn bar 108, passing around a side of second tension roller 110 and onto take-up cartridge 112. First tension roller 104 and second tension roller 110 may be adjustable so that the tension of indexable web 114 may be increased or decreased as desired. It may be appreciated that while indexable web station 100 employs first tension roller 104 and second tension roller 110, any suitable number of tension rollers may be employed to generate and maintain an appropriate amount of tension in web 114. Further, web 114 may take a variety of paths through indexable web station 100 depending on the desired configuration and features desired to be interposed within the indexable web station.

Figure 3:
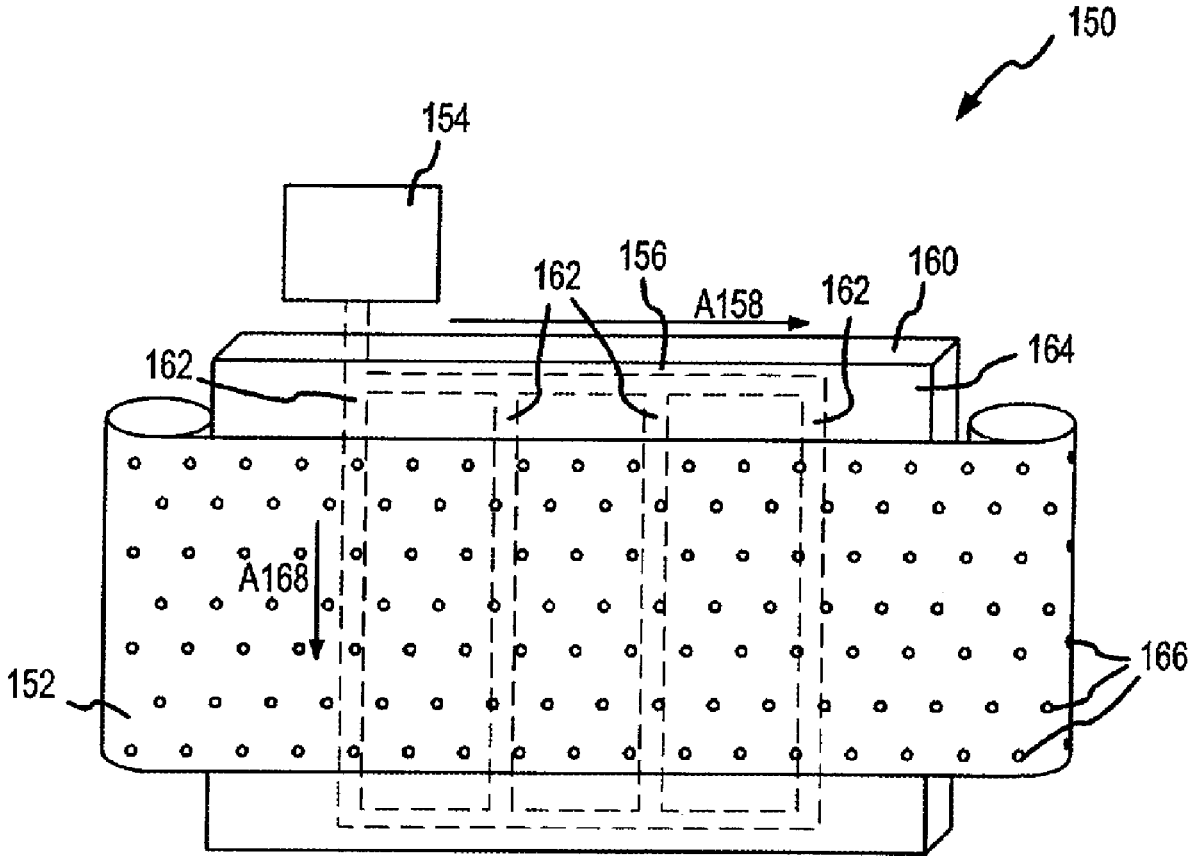
FIG. 3 is a perspective view illustration of a distribution manifold of an indexable web polishing station according to another embodiment of the present invention.

In a further embodiment of the present invention, as shown in FIG. 3, an indexable web station 150 may be configured so that fluids, such as a slurry or deionized water may be distributed through an indexable web 152. In contrast to rotating polishing stations, an orbiting polishing station provides the advantage that fluid may be supplied through the polishing station to the polishing surface, without the use of rotary unions or the like. A pump 154 may distribute the fluid through a distribution manifold 156 in the direction indicated by arrow A158 to one or more conduits 162 formed within supporting surface 160. Conduits 162 allow for easy transportation of the fluid through the supporting surface 160 as indicated by arrow A168. Conduits 162 may then distribute fluid to the top surface 164 of supporting surface 160. Indexable web 152 is configured with a plurality of holes 166 through which the fluid may flow to reach the top surface of web 152. In conventional applications, with the distribution system, the wafer typically acts like a squeegee preventing fluids from reaching the center of the wafer resulting in a nonuniform planarization process. This distribution system may be used to overcome the problem in the prior art of distributing fluids to the center of the wafer. In an alternative embodiment, pump 154 may distribute the fluid through distribution manifold 156 to one or more trenches formed on the top surface 164 of supporting surface 160. The fluid flows through the trenches in the direction of arrow A168 and through holes 166 of web 152.

The indexable web station of the present invention may be used in a variety of CMP apparatus. For example, the indexable web station may be used in a carousel-type CMP apparatus, such as the one shown in FIG. 4. This CMP apparatus has a base unit 220 and a rotatable carousel 230. Base unit 220 has a top surface 250 which surrounds three polishing stations, an indexable web polishing station 240 as described above, a conventional CMP polishing station 242, and a buffing station 244, and a wafer transfer station 260. Base unit 220 supports a transparent walled cover 270 which surrounds polishing stations 240, 242 and 244 and wafer transfer station 260 to catch waste product thrown by the polishing stations during polishing. Walled cover 270 further houses multi-wafer-carrier carousel 230, the number of wafer carriers of which may correspond to the number of polishing stations in addition to the wafer transport station. In the exemplary embodiment shown in FIG. 4, carousel 230 has four wafer carriers, 280*a*, 280*b*, 280*c* and 280*d*. Wafer carriers 280*a* –280 *d* receive and hold wafers W and polish them by pressing them against the respective polishing stations 240, 242 and 244. Each of the wafer carriers are equally spaced about the center of carousel 230 to align vertically with polishing stations 240, 242 and 244. Carousel 230 is supported by a center post 290 which is configured to permit carousel 230 to be rotated about its center axis by a motor (not shown) housed within base unit 220. While three polishing stations and a transfer station are shown in this exemplary embodiment, it will be appreciated that more polishing stations and/or transfer stations, or only one or two polishing stations may be used in the CMP apparatus. Similarly, while four wafer carriers are shown, one, two, three, five or more carriers may be used to suitably correspond to the number of polishing stations and transfer stations that are used.

Figure 5:
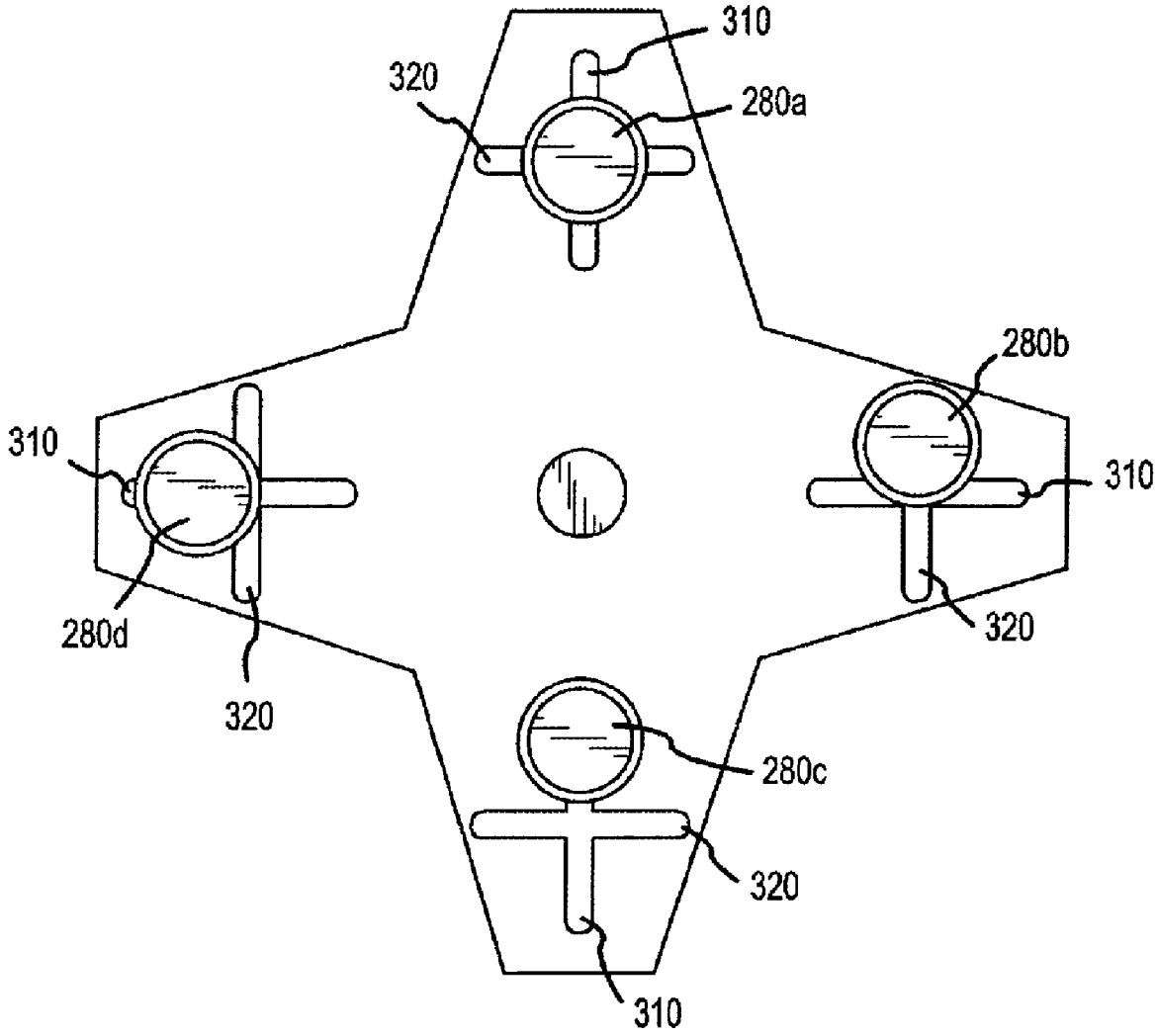
FIG. 5 is an underside view illustration of a carousel of a carousel CMP apparatus according to an embodiment of the present invention.

Each of the wafer carries 280*a* –280*d* is attached to the end of a cylindrical shaft 284 that is connected to a rotational drive mechanism by a gimbal assembly (not shown). When activated, the rotational drive mechanism causes the wafer carrier 280 to rotate about its own axis. In addition to rotation about their own axes, as shown in FIG. 5, wafer carriers 280*a*–280*d* are operatively connected to a carrier motor assembly (not shown) which may cause wafer carriers 280*a*–280*d* to translate radially along tracks 310 and laterally along tracks 320 formed in carousel 230. Wafer carriers 280*a*–280*d* can rotate and translate independently as driven by their dedicated rotational drive mechanisms and carrier motor assemblies.

Each of the wafer carriers 280 has a wafer head 282. The purposes of wafer head 282 is to help secure wafer W to wafer carrier 280 and also to prevent the wafer from becoming dislodged during planarization. Any of a number of different types of wafer heads can be used. For examples of suitable wafer heads, see the following patents, incorporated herein by this reference: U.S. Pat. No. 6,056,632, issued May 2, 2000 to Mitchel, et al.; U.S. Pat. No. 5,989,104, issued Nov. 23, 1999 to Kim, et al.; U.S. Pat. No. 6,024,630, issued Feb. 15, 2000 to Shendon et al.; U.S. Pat. No. 5,762,544, issued Jun. 9, 1998 to Zuniga et al.; U.S. Pat. No. 6,080,050, issued Jun. 27, 2000 to Chen et al; and U.S. Pat. No. 5,738,574, issued Apr. 14, 1998 to Tolles, et al.

Wafer carrier 280 may advance the wafer toward polishing stations 240, 242 and 244 and apply pressure such that the wafer engages the polishing surfaces of the polishing stations with a desired amount of force by a variety of mechanisms, for example, by expansion of a membrane assembly integral with wafer head 282, as more fully disclosed in U.S. Pat. No. 6,056,632. Alternatively, wafer carrier 280 may be operatively connected to a pneumatic assembly (not shown) which moves shaft 284 vertically, thus advancing the wafer vertically down toward polishing stations 240, 242 and 244 for polishing and moving the wafer vertically up after polishing.

In use, as described below, the wafer carriers 280*a*–280*d* are each initially positioned above the wafer transfer station 260. When the carousel 230 is rotated, it positions different wafer carriers 280*a*–280*d* over the polishing stations 240, 242 and 244 and the transfer station 260. The carousel 230 allows each wafer carrier to be sequentially located first over the transfer station 260, then over one or more of the polishing stations 240, 242 and 244 and then back to transfer station 260.

Figure 4:
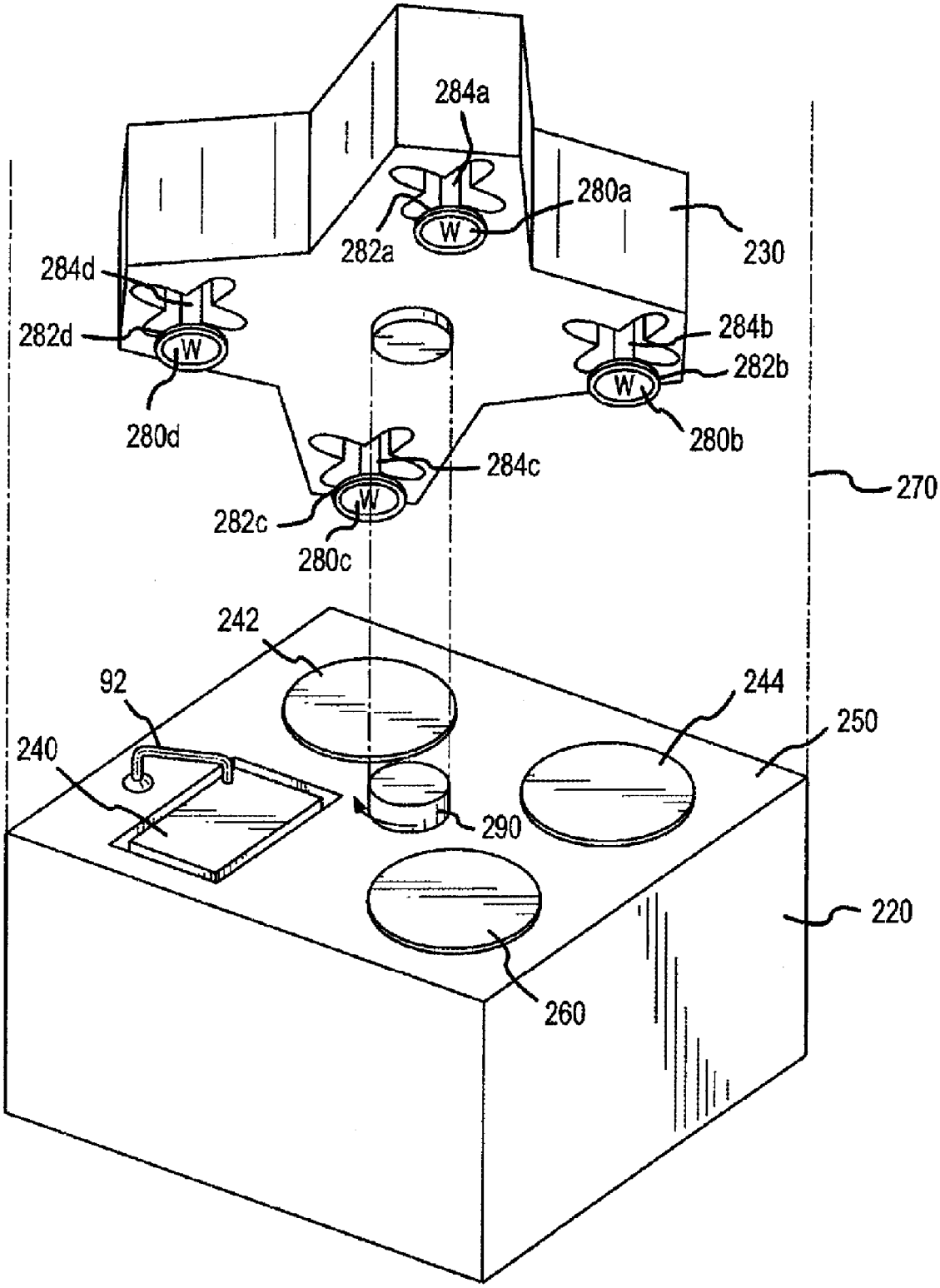
FIG. 4 is an oblique view illustration showing a carousel CMP apparatus employing an indexable web polishing station according to an embodiment of the present invention.
Figure 6:
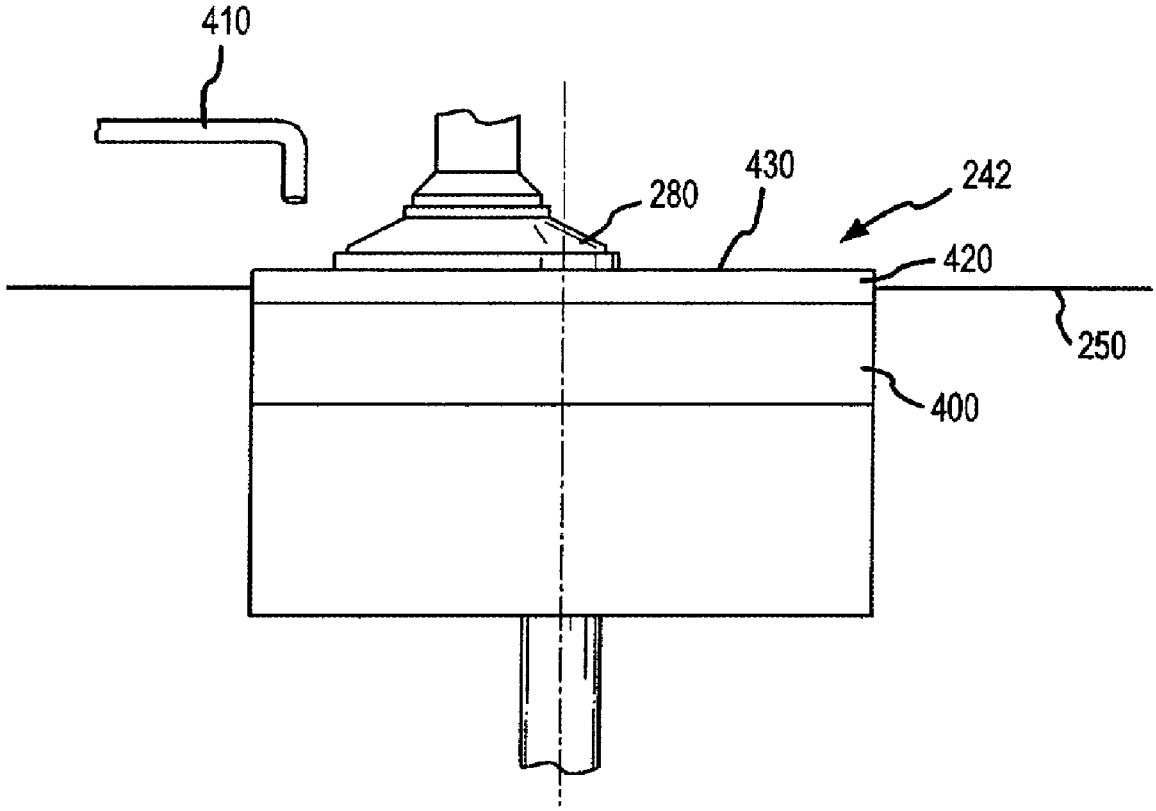
FIG. 6 is a side view of an exemplary embodiment of a CMP polishing station of the present invention.

Referring to FIGS. 4 and 6, CMP polishing station 242 includes a polishing platen 400 mounted for rotation by a drive motor (not shown). Alternatively, polishing platen 400 may be suitably configured for orbital motion, as described above. The polishing platen may be relatively large in comparison to wafer W so that, during the CMP process, wafer W may be moved across polishing platen 400 for planarizing and polishing wafer W. Polishing platen 400 may be formed of a hard incompressible material such as metal.

A polishing pad 420 is mounted to polishing platen 400. In accordance with the present invention, a polishing pad 420 is used that is formed of a hard and low compressibility material to provide a flat planar contact surface 430 for planarizing the wafer W. According to the present embodiment, a hard polish pad IC1000 (product name) made by Rodele Nitta Company is used to polish wafer W, although it will be appreciated that any suitable polishing pad may be used. A polishing slurry containing an abrasive medium, such as silica or alumina, is deposited through a conduit 410 onto the surface of the polishing pad 420.

Figure 7:
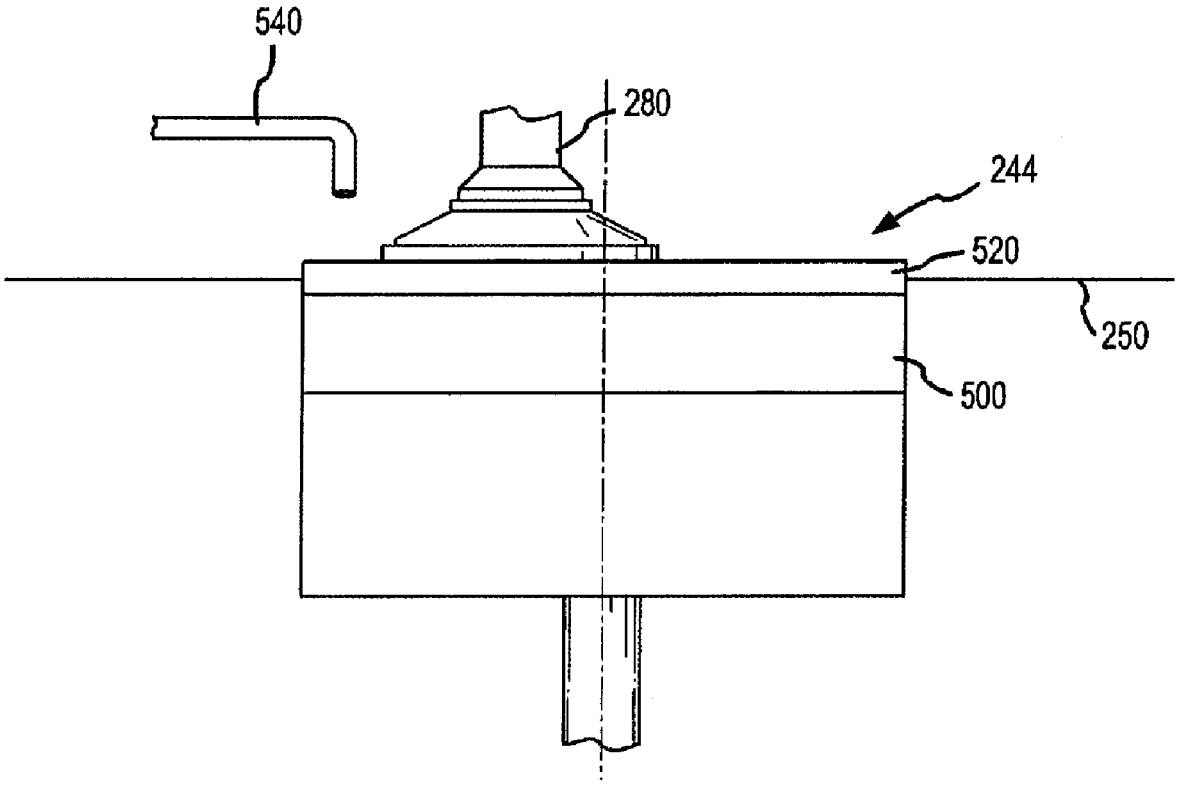
FIG. 7 is a side view of an exemplary embodiment of a buffing/polishing station according to an embodiment of the present invention.

Subsequent to planarizing wafer W with a hard low compressibility pad 420, wafer W may be polished to remove microscratches formed by the indexable web and the hard pad. Referring to FIGS. 4 and 7, buffing station 244 includes a polishing platen 500 mounted for rotation by a drive motor (not shown). Alternatively, polishing platen 500 may be suitably configured for orbital motion, as described above. The polishing platen may be relatively large in comparison to wafer W so that, during buffing, wafer W may be moved across polishing platen 500 for buffing and polishing wafer W. A soft polish pad 520 is used to buff and polish wafer W. Soft polish pad 520 may be formed of a soft compressible material, such as blown polyurethane. A suitable polishing pad 520 may be obtained from Rodele Nitta Company and designated SUPREME (product name). One or more fluids (DI water, slurry, buffing solution, etc.) may be applied to polishing pad 520 through a conduit 540 via a fluid pump (not shown).

Figure 8:
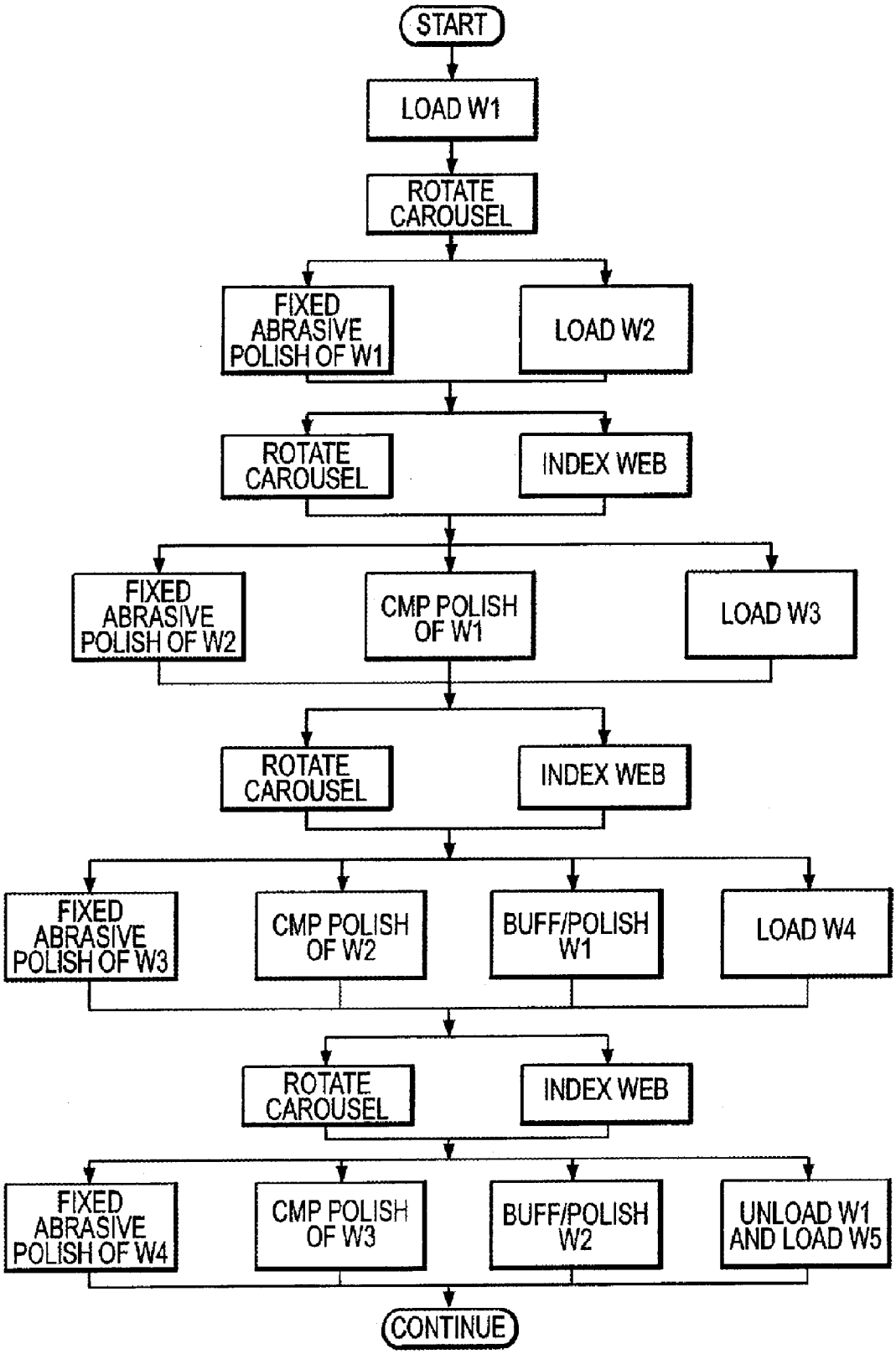
FIG. 8 is a block diagram of the method for polishing a wafer with the carousel CMP apparatus according to an embodiment of the present invention.
Figure 9:
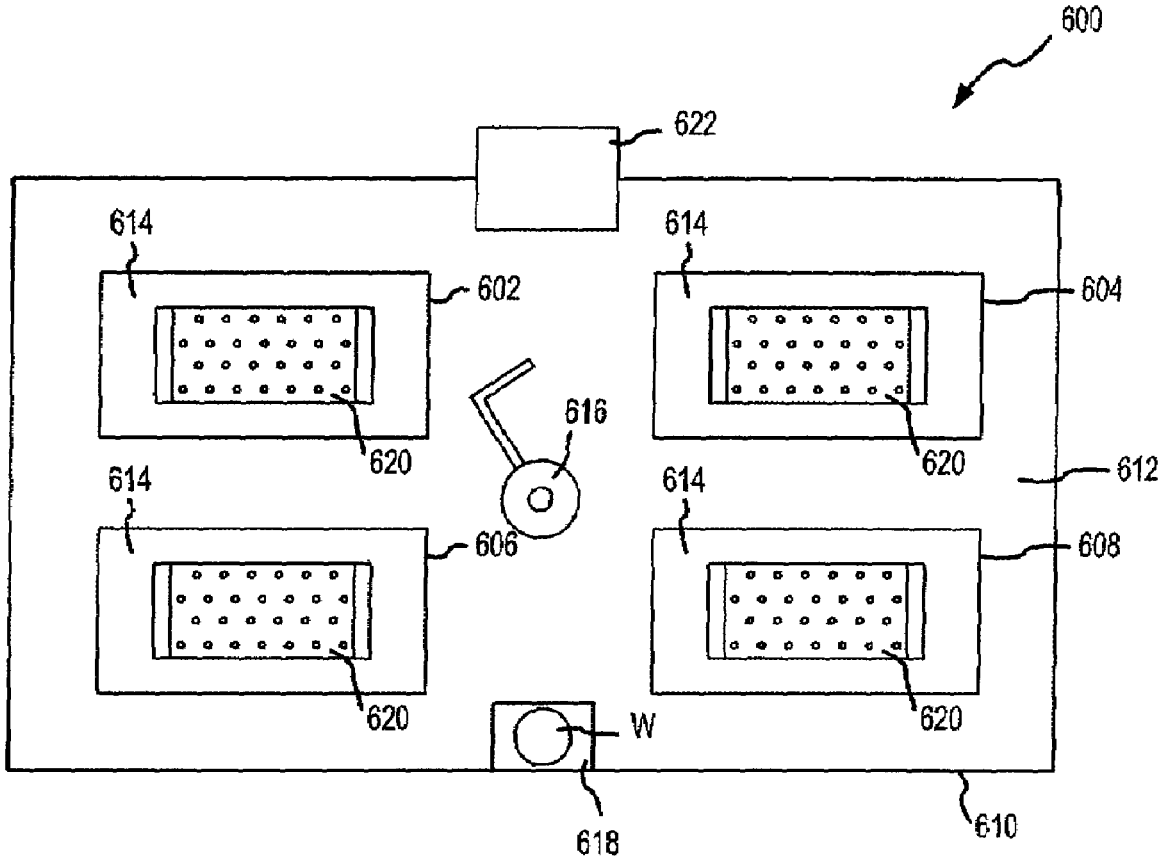
FIG. 9 is a top view illustration of another exemplary embodiment of a CMP apparatus employing orbiting indexable web polishing stations of the present invention.

Next, with reference to FIGS. 1, 4 and 8, operations of the CMP apparatus thus structured using the indexable web polishing station of the present invention will be described. The description begins with the insertion of wafer W and continues with the subsequent movement of wafer carriers 280*a*, 280*b*, 280*c* and 280*d* supported by carousel 230.

A first wafer W1 is loaded from a loading apparatus (not shown) to transfer station 260, which loads the wafer into wafer carrier 280*a*. Carousel 230 is then rotated clockwise on center post 290 so as to position wafer carrier 280*a* and wafer W1 over indexable web polishing station 240. Indexable web polishing station 240 performs a first-stage polish of wafer W1. While indexable web polishing station 240 is polishing wafer W1, a second wafer W2 is loaded from the loading apparatus to transfer station 260 and from there to wafer carrier 280*b*, now positioned over transfer station 260.

After the indexable web polishing of wafer W1 is completed, and after wafer W2 has been loaded into wafer carrier 280*b*, carousel 230 is rotated clockwise so that wafer W1 is positioned over conventional CMP polishing station 242, wafer W2 is positioned over indexable web polishing station 240, and wafer carrier 280*c* is positioned over transfer station 260. If new roll cartridge 20 contains sufficient unused web 12 to process another wafer, web 12 is advanced to expose an unused segment of web 12 at indexable web polishing station 240. Alternatively, indexable web polishing station 240 may be configured so that web 12 is intermittently or continuously incremented during planarization of the wafers.

Indexable web polishing station 240 performs a first-stage polish of wafer W2, CMP polishing station 242 performs a second-stage CMP polishing of wafer W1 and a third wafer W3 is loaded from the loading apparatus to transfer station 260 and from there to wafer carrier 280*c*, now positioned over transfer station 260.

After the second-stage polishing of wafer W1, the first-stage polishing of wafer W2 and loading of wafer W3 into wafer carrier 280*c*, carousel 230 is again rotated clockwise so that wafer W1 is positioned over buffing station 244, wafer W2 is positioned over CMP polishing station 242, wafer W3 is positioned over indexable web polishing station 240, and wafer carrier 280*d* is positioned over transfer station 260. If new roll cartridge 20 contains sufficient unused web 12 to process another wafer, web 12 is advanced to expose an unused segment of web 12. Indexable web polishing station 240 then performs a first-stage polish of wafer W3, CMP polishing station 242 performs a second-stage CMP polishing of wafer W2, buffing station 244 performs a third-stage buffing/polishing of wafer W1 and a fourth wafer W4 is loaded from the loading apparatus to transfer station 260 and from there to wafer carrier 280d, now positioned over transfer station 260.

After the third-stage polishing of wafer W1, the second-stage polishing of wafer W2, the first-stage polishing of wafer W3 and the loading of wafer W4 into wafer carrier 280*d*, carousel 230 is rotated counterclockwise so that wafer carrier 280*a* and wafer W1 are positioned above transfer station 260, wafer carrier 280*b* and wafer W2 are positioned above buffing station 244, wafer carrier 280*c* and wafer W3 are positioned above CMP polishing station 242 and wafer carrier 280*d* and wafer W4 are positioned above indexable web polishing station 240. Counterclockwise rotation back to carousel's 230 original starting position eliminates the need for rotary couplings to carousel 230. Alternatively, carousel 230 may be configured to continue rotating in the clockwise direction so that wafer carrier 280*a* and wafer W1 are positioned above transfer station 260, wafer carrier 280*b* and wafer W2 are positioned above buffing station 244, wafer carrier 280*c* and wafer W3 are positioned above CMP polishing station 242 and wafer carrier 280*d* and wafer W4 are positioned above indexable web polishing station 240.

If new roll cartridge 20 contains sufficient unused web 12 to process another wafer, web 12 is advanced to expose an unused segment of web 12. Indexable web polishing station 240 then performs a first-stage polish of wafer W4, CMP polishing station 242 performs a second-stage CMP polishing of wafer W3, buffing station 244 performs a third-stage buffing/polishing of wafer W2 and wafer W1 is washed at the transfer station 260 by a washer (not shown) and is loaded from wafer carrier 280*a* back to the loading apparatus. A fifth wafer W5 is then loaded onto transfer station 260 and then into wafer carrier 280*a*. The process then repeats with clockwise rotation of carousel 230 after the first-, second- and third-stage polishings have been completed of wafers W4, W3 and W2, respectively.

The indexable web polishing station of the present invention may also be used in an integrated, multiple polishing station system, such as the Avantgaard 776 CMP System by Speedfam-IPEC, Inc. Such multiple polishing station systems may have two or more polishing stations for performing CMP on wafers. Referring to FIG. 10, a multiple polishing station apparatus 600 is illustrated having four polishing stations 602, 604, 606 and 608, although it will be appreciated that multiple polishing station 600 may have one, two or any other suitable number of polishing stations. Polishing stations 602, 604, 606 and 608 each may be indexable web polishing stations, according to the present invention, that are configured to move orbitally.

Indexable web polishing stations 602, 604, 606 and 608 are positioned within a base 610 having a top surface 612. Top surface 612 is configured with a number of openings 614 to correspond to the number of polishing stations employed by multiple polishing station apparatus 600. Openings 614 are large enough to permit the indexable web polishing stations to orbit without interference from base 610. A wafer handling robot 616 is centered between the polishing stations and is configured to transport a wafer from a transfer station 618 to one of the polishing stations for polishing and back to the transfer station after polishing.

Multiple polishing station apparatus 600 employs wafer carriers (not shown), the number of which may correspond to the number of polishing stations. The wafer carriers receive wafers from the wafer handling robot 616 and hold the wafers and polish them by pressing them against the respective indexable web polishing stations 602, 604, 606 and 608. Each of the wafer carriers aligns vertically with a corresponding polishing station and is attached to the end of a cylindrical shaft that is configured to rotate the wafer carriers and the wafer around a longitudinal axis of the shaft. In addition to rotation about the longitudinal axis, the wafer carriers may be configured to translate radially or otherwise oscillate. Alternatively, the wafer carriers may be suitably configured to move orbitally so that during polishing the wafer carrier and the indexable web polishing station both move orbitally, preferably in opposite directions.

During operation of multiple polishing station apparatus 600, robot 616 receives a wafer W from transfer station 618. Robot 616 then positions wafer W proximate to one of the polishing stations 602, 604, 606 or 608. A wafer carrier aligned vertically about the respective polishing station receives wafer W from robot 616. The wafer carrier then urges wafer W against an indexable web 620 of the indexable web polishing station. The wafer carrier presses wafer W against the indexable web 620 as it rotates or, alternatively, orbits. The indexable web polishing station orbits, as described above, to uniformly planarize and polish wafer W. After polishing of wafer W, the wafer carrier raises wafer W above the indexable web polishing station. Robot 616 then moves into a suitable position to receive wafer W from the wafer carrier. Robot 616 may then transport wafer W to a buffing station 622 for buffing of wafer W. After buffing of wafer W, robot 616 removes wafer W from buffering station 622 and back to transfer station 618. If the new roll cartridge contains sufficient unused web to process another wafer, web 620 is advanced to expose an unused segment of web 620. Alternatively, the indexable web polishing stations may be configured so that web 620 is intermittently or continuously incremented during planarization of the wafers.

While multiple polishing station apparatus 600 is illustrated in FIG. 10 with all polishing stations 602, 604, 606 and 608 employing indexable web polishing stations, it will be appreciated that in an alternative embodiment only one of the multiple stations may employ an orbiting indexable web polishing station, with the other polishing stations employing any suitable polishing apparatus. For example, in one embodiment of the multiple polishing station 600, only one indexable web polishing station may be employed, while the other polishing stations employ conventional rotating polishing platens. Accordingly, wafer W may be polished first at the indexable web polishing station and subsequently at a conventional CMP rotating or orbiting platen. In another embodiment, one orbital indexable web polishing station may be employed, while the other indexable web polishing stations do not orbit.

Although the subject invention has been described herein in conjunction with the appended drawing Figures, it will be appreciated that the scope of the invention is not so limited. Various modifications in the arrangement of the components discussed and the steps described herein for using the subject device may be made without departing from the spirit and scope of the invention as set forth in the appended claims.

What is claimed is:

1. An apparatus for planarizing a workpiece comprising:

a) a web having a face, wherein said face comprises microreplicated structures with fixed abrasives and is positioned adjacent said workpiece during planarization;

b) at least one tension assembly configured to maintain tension of said web;

c) an orbiting assembly configured to orbit said web relative to said workpiece wherein the radius of orbit of the web is less than the radius of the workpiece; and d) a manifold apparatus configured to effect fluid flow to said face of said web.

2. An apparatus for planarizing a workpiece comprising:

a) a plurality of polishing stations wherein at least one of said plurality of polishing station comprises a web with a first face which is positioned adjacent said workpiece during planarization;

b) an orbiting assembly configured to orbit said web relative to said workpiece wherein said first face of said web comprises fixed abrasives; and c) a manifold apparatus configured to effect fluid flow to said first face of said web.

3. The apparatus of claim 2 wherein said first face of said web comprises fixed abrasives.

4. The apparatus of claim 2 further comprising a drive mechanism for indexing said web a predetermined amount.

5. The apparatus of claim 4 wherein said web is indexed intermittently during planarization of said workpiece.

6. The apparatus of claim 4 wherein said web is indexed continuously during planarization of said workpiece.

7. The apparatus of claim 4 wherein said web is indexed between planarization of a first workpiece and planarization of a second workpiece.

8. The apparatus of claim 2 wherein said web has a second face and wherein said apparatus further comprises a supporting surface in contact with said second face.

9. The apparatus of claim 8 further comprising:

a new roll cartridge configured for holding an unused portion of said web and allowing said web to be incrementally drawn under tension and moved over the supporting surface; and a take-up cartridge for receiving a used portion of said web.

10. The apparatus of claim 2 further comprising at least one tension device configured to maintain a tension of said web.

11. The apparatus of claim 2 further comprising a plurality of workpiece carriers, the number of which corresponds to the number of said polishing stations, wherein each of said plurality of workpiece carriers is configured to carry a workpiece and press said workpiece against said polishing station while causing relative motion between said workpiece and said polishing station.

12. The apparatus of claim 2 wherein said web comprises holes through which fluid from said manifold apparatus may flow.

13. The apparatus of claim 10 wherein said tension device may be adjusted to adjust the tension of said web.

14. The apparatus of claim 11 wherein said relative motion is selected from the group comprising linear motion, orbital motion, rotary motion, linear and orbital motion, linear and rotary motion, orbital and rotary motion, and linear, orbital and rotary motion.

15. An apparatus for planarizing a workpiece comprising:

a) a web having a face, wherein said face wherein said face comprises microreplicated structures with fixed abrasives and is positioned adjacent said workpiece during planarization;

b) at least one tension assembly configured to maintain tension of said web;

c) an orbiting assembly configured to orbit said web relative to said workpiece wherein the radius of orbit of the web is less than the radius of the workpiece; and d) a workpiece carrier configured to carry a workpiece and press said workpiece against said face of said web while the workpiece carrier rotates said workpiece about a vertical axis.

16. An apparatus for planarizing a workpiece comprising:

a)a web having a face wherein said face comprises microreplicated structures with fixed abrasives and is positioned adjacent said workpiece during planarization;

b) at least one tension assembly configured to maintain tension of said web;

c) an orbiting assembly configured to orbit said web relative to said workpiece wherein the radius of orbit of the web is less than the radius of the workpiece; and d) a workpiece carrier configured to carry a workpiece and press said workpiece against said face of said web while the workpiece carrier moves said workpiece in an orbital pattern.

17. The apparatus of claim 1 wherein said web comprises holes through which fluid from said manifold apparatus may flow.

* * * * *